US006971940B2

(12) United States Patent
Cohen et al.

(10) Patent No.: US 6,971,940 B2
(45) Date of Patent: Dec. 6, 2005

(54) ILLUMINATED FLYING DISC

(76) Inventors: Adam Cohen, 5200 Peachtree Rd., Apt. 2108, Chamblee, GA (US) 30341; Stephen S. Roma, 138 Bodman Pl., Unit 7, Redbank, NJ (US) 07701

( * ) Notice: Subject to any disclaimer, the term of this patent is extended or adjusted under 35 U.S.C. 154(b) by 0 days.

(21) Appl. No.: 10/228,797

(22) Filed: Aug. 27, 2002

(65) Prior Publication Data

US 2004/0043694 A1 Mar. 4, 2004

(51) Int. Cl.[7] ..... A63H 27/00
(52) U.S. Cl. ..... 446/47; 473/570
(58) Field of Search ..... 446/46, 47, 34, 446/219; 473/570, 590; 244/12.2, 23 C

(56) References Cited

U.S. PATENT DOCUMENTS

| | | | | |
|---|---|---|---|---|
| 3,359,678 | A * | 12/1967 | Headrick | 446/46 |
| 3,576,987 | A | 5/1971 | Kurt et al. | |
| 3,798,834 | A * | 3/1974 | Samuel | 446/47 |
| 3,812,614 | A | 5/1974 | Harrington | |
| 4,086,723 | A * | 5/1978 | Strawick | 446/47 |
| 4,207,702 | A * | 6/1980 | Boatman et al. | 446/48 |
| 4,254,575 | A * | 3/1981 | Gould | 446/46 |
| 4,255,895 | A * | 3/1981 | LaBrecque | 446/47 |
| 4,906,007 | A * | 3/1990 | Mitchell | |
| 5,078,637 | A | 1/1992 | McFarland | |
| 5,083,799 | A * | 1/1992 | Thill | 473/588 |
| 5,536,195 | A | 7/1996 | Stamos | |
| 5,720,651 | A * | 2/1998 | Chien | 451/95 |
| 6,402,342 | B1 * | 6/2002 | Chiang | 362/253 |
| D466,562 | S * | 12/2002 | Peterson | D21/443 |
| 2003/0162470 | A1 * | 8/2003 | Peterson | 446/46 |

OTHER PUBLICATIONS www.nightfrizsee.com, 2002.

* cited by examiner

*Primary Examiner*—Bena Miller
(74) *Attorney, Agent, or Firm*—Hedman & Costigan, P.C.

(57) ABSTRACT

An illuminated flying disc may have adapted to attach a light source to the disc in the area of the rim in a manner that may have no substantial effect on the aerodynamic qualities of the device and is sufficient to hold the light source in place while throwing and upon impact with obstacles, said device being durable, safe and easy to use.

13 Claims, 4 Drawing Sheets

ILLUMINATED FLYING DISC

FIELD OF INVENTION

The present invention relates to an aerodynamic flying disc device, such as that known as the FRISBEE, for use in throwing games. More particularly, the present invention relates to an illuminated flying disc device that that can be used in low-light conditions. Most particularly, the present invention is related to an illuminated flying disc device that is durable, safe, easy to use and retains it aerodynamic properties.

BACKGROUND OF INVENTION

Since the late 1950's, the plastic flying disc sold under the trademark "FRISBEE" has been hugely popular. The disc is capable of sailing through the air when thrown from one person to another, or when thrown in boomerang fashion. When thrown, the disc is rotated about its own axis for stability while traveling generally perpendicular to that axis at the same time. One example of the disc is disclosed in U.S. Pat. No. 3,359,678. Use of such flying discs has come to be regarded as a serious sport by certain FRISBEE aficionados and FRISBEE tournaments and competitions are commonplace.

Over the past years, flying disc devices that make the disc visible in low-light conditions have also become quite popular. Some of the disadvantages of the prior art illuminated flying discs are that the light source and/or its structure interferes with the throwing and catching of the disc and, in some instances, can scrape or otherwise injure the user's hand. In addition, the light source on such discs often adversely affects their aerodynamic properties. Further, some such devices are not durable and/or do not comport with the 175 gram weight of the standard FRISBEE desired by many FRISBEE aficionados.

Illuminated flying disc devices take many forms. Many such devices use chemiluminescent light sources. For instance, Stamos, U.S. Pat. No. 5,536,195, teaches a flying disc illuminated by use of a chemiluminescent container attached to the central portion of the device. Thill, U.S. Pat. No. 5,083,799, also teaches a flying disc illuminated by a chemiluminescent container attached to the central portion of the device. Gould, U.S. Pat. No. 4,254,575, teaches a flying disc that includes a system for chemiluminescent illumination by use of a hoop-shaped holder on the underside of the device. Boatman, U.S. Pat. No. 4,207,702, teaches a flying disc with a chemiluminescent light source that is attached to the top of the device. Strawick, U.S. Pat. No. 4,086,723, teaches a flying disc adapted to attach a chemiluminescent light source to the underside of the device.

No prior art, however, teaches or suggests an illuminated flying disc device with a light source attached to the annular rim of the flying disc which device is durable, safe, easy to use and retains its aerodynamic properties.

SUMMARY OF INVENTION

The present invention concerns an illuminated flying disc device that can be used in low-light conditions.

Thus, it is an object of the present invention to provide a useful illuminated flying disc device including means for attaching a light source thereto.

It is another object of the invention to provide a useful illuminated flying disc device of the character described that retains its advantageous aerodynamic properties.

Further, it is an object of the present invention to provide a useful illuminated flying disc device that is durable, safe and easy to use.

It is a further object of this invention to provide a useful illuminated flying disc device that is relatively cost-efficient to manufacture.

These and other objectives will become evident to those skilled in the art from the specification. Such objectives are accomplished by the illuminated flying disc of the present invention that comprises: a circular disc comprising a generally flat circular central portion with an annular rim surrounding it, said rim being integrally formed therewith and extending outwardly of the plane of the circular portion. The circular portion and rim define a generally convex surface forming the outer side of the disc and a generally concave surface forming the inner side of the disc. The rim includes a means for attaching at least one light source thereto.

DETAILED DESCRIPTION OF THE INVENTION

The following description of preferred embodiments is presented to illustrate the present invention and is not to be construed to limit the scope of the appended claims in any manner whatsoever.

Figure 1:
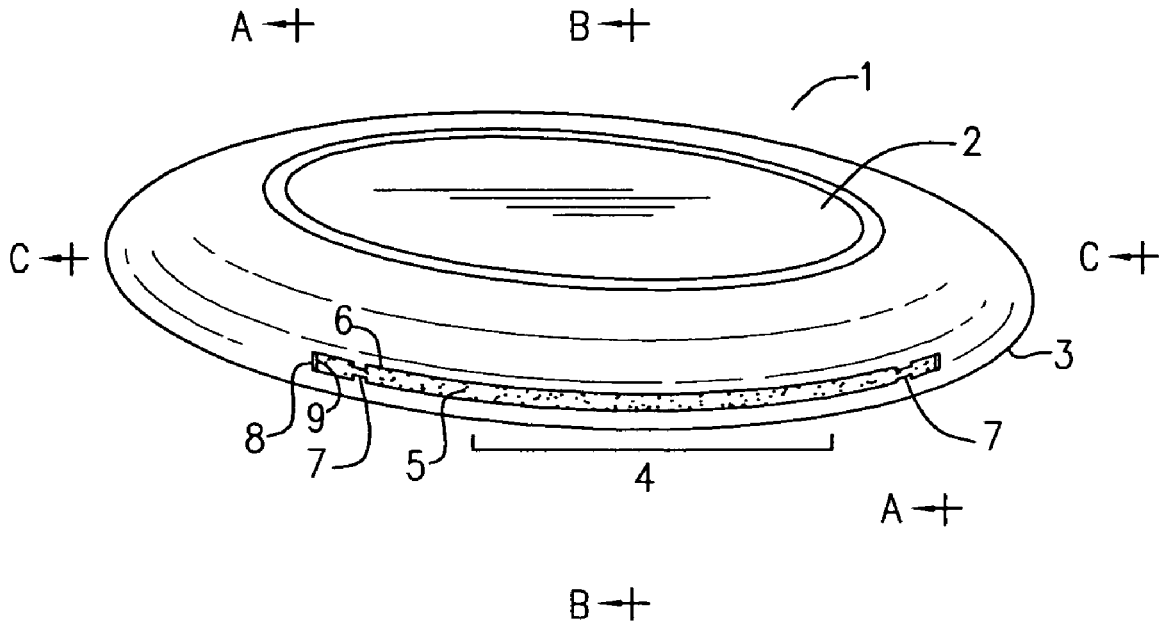
FIG. 1 is a perspective view of one embodiment of the present invention using a chemiluminescent light source.

Referring to FIG. 1, the illuminated flying disc comprises: a circular disc 1 comprising a generally flat circular central portion 2, having two opposing sides thereto and a rim 3. Said rim 3 is integrally formed with the central portion 2, extends outwardly of the plane of the circular portion and has a somewhat greater thickness than the circular central portion 2 of the device. The rim 3 curves downwardly from the central portion 2 and has a configuration such that the device, when viewed in elevation, approximates the shape of an airfoil. The circular portion 2 and rim 3 define a generally convex surface forming the outer side of the disc and a generally concave surface forming the inner side of the disc. As more fully explained below, the rim 3 has at least one means 4 for attaching at least one light source 5 to the rim 3.

The structural details of the circular disc 1, with the exception of the rim, are similar to conventional flying disc devices in common use. In the preferred embodiment depicted, the circular disc 1 corresponds to the weight and diameter of the standard FRISBEE. However, devices of other weights and dimensions are within the full-intended scope of the present invention.

The circular disc 1 may be molded of polyethylene or any other suitable material known to those skilled in the art. In one preferred embodiment, the material of which the circular disc 1 is made is semi-translucent so that the light emitted from the light source not only appears from the rim 3 of the device as it is flown, but also is emitted from the entire device. In other preferred embodiments, the material of which the circular disc is made is glow-in-the-dark to further enhance the visual appearance of the device. In still further embodiments, the material of which the circular disc is made is opaque, which gives the disc yet another appearance.

The preferred embodiment of the present invention shown includes at least one flexible, resilient chemiluminescent light source attached to the rim of the disc 1. However, in other embodiments, any number of light sources may be employed.

Chemiluminescent light sources are well known in the art. Briefly, a chemiluminescent light source may include a pair of reactant compounds, one of which is positioned in a thin glass tube and the other of which is positioned in a pliable plastic tube that completely surrounds the inner glass tube, thus providing a self-contained device. In order to mix the chemicals and provide a reaction that produces light, the outer plastic container is bent until the inner glass container breaks, providing mixture of the compounds. The light source produced is generally non-heat generating.

Suitable light sources are commercially available, generally referred to as glow sticks. One such product is sold by Global One as a bracelet, being about 8" in length and having diameters of about 5 and/or 6 mm. Once activated, the chemiluminescent light source provides light for approximately eight (8) hours. Although the use of a chemiluminescent light source is described herein, it will be understood that light sources of other kinds, with longer or shorter useful lives, and/or of other compositions, may be advantageously employed.

FIG. 1 further depicts a preferred embodiment wherein the outside of the rim has at least one means 4 for attaching at least one light source 5. The attaching means 4 comprises a groove 6 formed in the perimeter of the rim 3 with the light source 5 being recessed to a depth of from about 10 percent to about 75 percent of the diameter of the light source 5. The sidewalls of the groove 6 frictionally engage the light source 5 to retain the light source in the groove 6. The groove 6 is of such a diameter such that the light source 5 will snap into the groove. Further, in a most preferred embodiment, the light source 5 is further held in place by one or more bifurcated clips 7. Of course, the light source 5 can be placed on the inside of the rim 3 or bottom end of the rim 3 as a design choice.

In the depicted embodiment, two sets of bifurcated clips 7 are positioned at opposite ends of the groove 6 and are integrally formed with the rim 3 of the circular disc 1 to assist in retention of the light source 5. The clips 7 further allow the light source 5 to be snapped into position and provide firm gripping for the same as attached therein. In other embodiments, none or any number of clips 7 or sets thereof may be employed and their positions may vary.

The rim 3 is preferably of a sufficient thickness such that a groove 6 of sufficient size can be formed therein. Said groove 6 is most preferably shaped in the form of a "C" so as to hold the light source 5 in place. When the light source is snapped into the "C" shaped groove 6, it may replace all or part of the material from which the disc 1 is made that would otherwise be contained therein.

In a most preferred embodiment, the perimeter of the disc is essentially smooth and the contour thereof substantially matches that of the standard FRISBEE when the light source is snapped into the groove 6.

In a most preferred embodiment, the groove 6 around the perimeter is separated into two (2) eight (8) inch sections, to receive two (2) eight (8) inch light sources 5. However, in other embodiments, fewer or more grooves 6 with a corresponding number of appropriately sized light sources 5 may be used.

In a most preferred embodiment, the light source 5 is attached to the rim 3 in a manner that has no substantial effect on the aerodynamic qualities of the device. In addition, the light source 5 is attached to the rim 3 in a manner such that the user's hand will not be scraped or injured when tossing or catching the disc. In the depicted embodiment, the groove 6 and sets of bifurcated clips 7 are sufficient to hold the light source in place while throwing and upon impact with obstacles, yet, at the same time, do not hinder the placement or removal of the light source 5.

In some preferred embodiments, the transition from groove to separation 8 includes a ramp 9 to assist in the removal and replacement of spent light sources. In addition, the distal ends of the groove 6 may be made larger than the center section of the groove to further ease removal of the light source 5.

Figure 2:
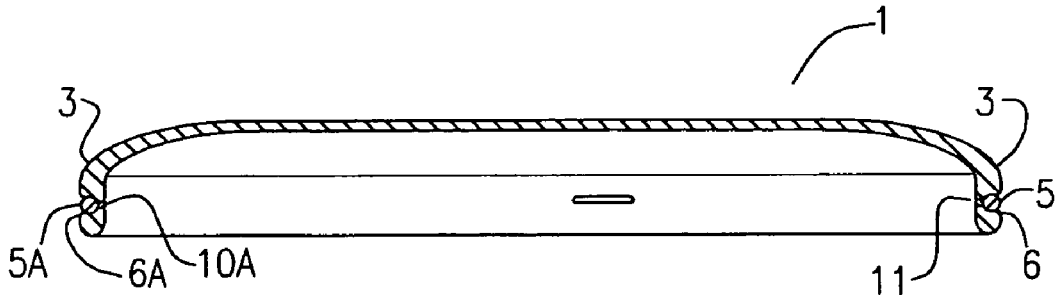
FIG. 2 is a cross-sectional view of one embodiment of the present invention taken substantially along line A—A of FIG. 1.
Figure 2A:
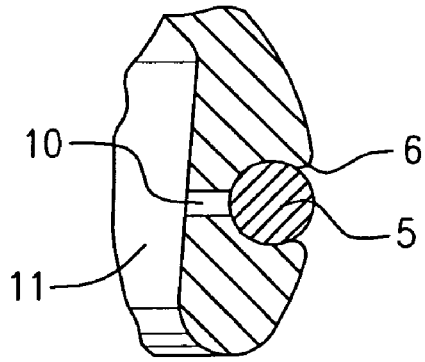
FIG. 2A is a detailed view of the rim of one embodiment of the present invention showing the rim and light source shown in FIG. 2.

FIGS. 2 and 2A, show that the groove 6 may have at least one end an aperture 10 allowing the light source 5 to be pushed out through the inner surface 11 of the rim 3 to assist in removal. Also shown in FIG. 2 is the same configuration for a second groove 6A, light source 5A and aperture 10A.

The attached drawings depict an embodiment wherein the light source 5 is removably attached to the perimeter of the rim 3. In other preferred embodiments, the light source 5 may be permanently attached to the perimeter of the rim 3, especially where the light source 5 has a greater useful life then the light source 5 described above. In still further embodiments, the light source 5 may be either permanently or removably attached to the perimeter of the inside or to the bottom of the rim 3.

Figure 3:
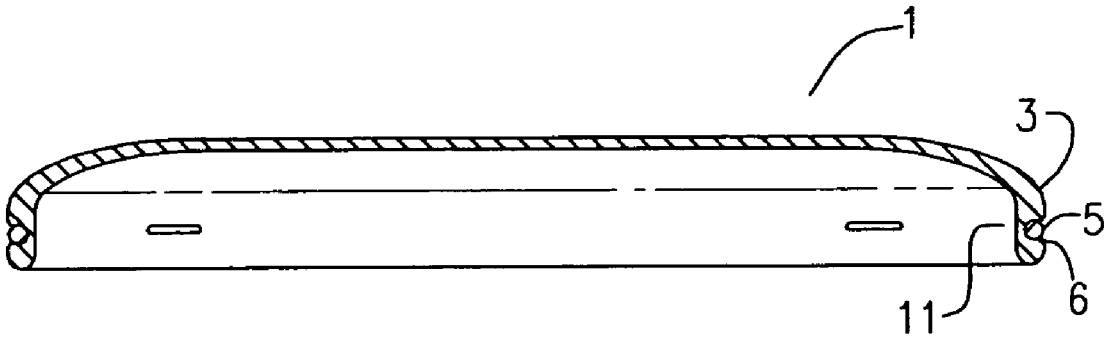
FIG. 3 is a cross-sectional view of one embodiment the present invention taken substantially along line B—B of FIG. 1.
Figure 3A:
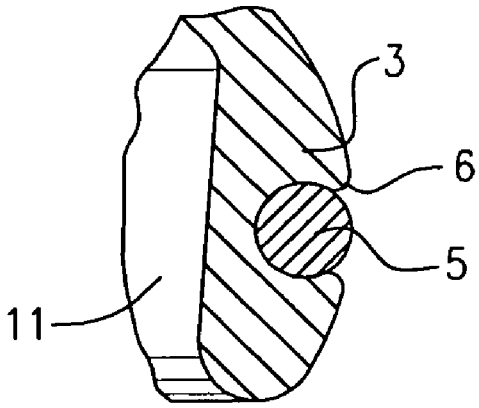
FIG. 3A is a detailed view of the rim of one embodiment of the present invention showing the rim and light source shown in FIG. 3.

FIG. 3 depicts a cross-sectional view of one embodiment the present invention taken substantially along line B—B of FIG. 1. Therein is shown the portion of the groove 6 in the rim 3 containing the light source 5. In the view depicted, no aperture 10 is shown in said central portion of the groove 6. However, an additional aperture or apertures 10 and/or a complete perforation in rim 3 behind the groove 6 is within the full-intended scope of the present invention. FIG. 3A depicts a detailed cross-sectional view of the rim 3 of one embodiment of the present invention, showing the light source 6 of FIG. 3 engaged by the groove 6.

Figure 4:
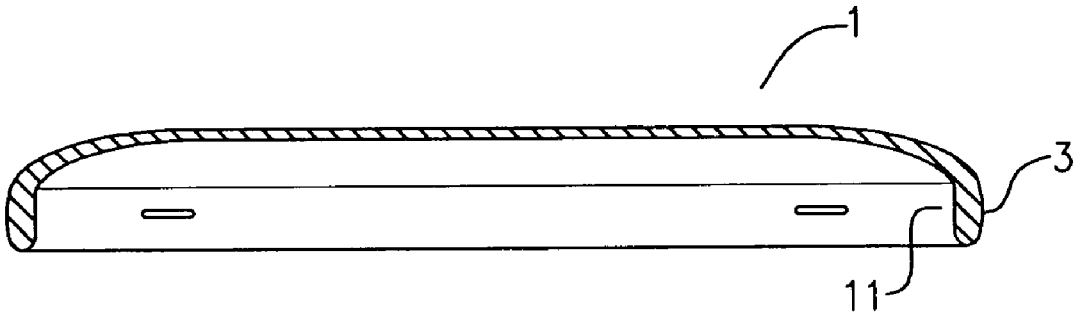
FIG. 4 is a detailed sectional view of one embodiment of the present invention taken substantially along line C—C of FIG. 1.

FIG. 4 is a detailed sectional view of one embodiment of the present invention taken substantially along line C—C of FIG. 1, i.e., the area of the rim that does not have a groove 6 or light source 5.

All of the above referenced patents are incorporated by reference herein. Many variations of the present invention will suggest themselves to those skilled in the art in light of the above description. All such modifications are within the full-intended scope of the claims.

We claim:

1. An illuminated aerodynamic disc device comprising in combination:

a circular disc made of a moldable plastic material comprising a circular central portion having two opposing sides thereto;

an annular rim surrounding said central portion and integrally formed therewith, said rim having an inner side and an outer side;

at least one means for removable attachment of a replaceable light source located on said outer side of said rim;

at least one replaceable light source engaged by said attachment means, said light source being chemiluminescent disposed in a plane substantially parallel to the central portion of the disc;

and wherein said means for removable attachment of said light source extend less than 360° around the rim.

2. The disc of claim 1 wherein said attachment means comprises an elongated groove formed in the rim, wherein said groove frictionally engages the light source to assist in holding said light source onto said rim.

3. The disc of claim 2 wherein the depth of the groove is substantially equal to the diameter of the light source.

4. The disc of claim 2 wherein said attachment means further comprises one or more clips that engage the light source on said rim adjacent said groove to assist in holding said light source on said rim.

5. The disc of claim 1 wherein said light source is at least about 5 mm in diameter.

6. The disc of claim 1 wherein said attachment means is located on the perimeter of said annular rim.

7. The disc of claim 1 wherein the device weighs about 175 grams and is about 10½ inches in diameter.

8. An illuminated aerodynamic disc device comprising in combination:

a circular disc made of a moldable plastic material comprising a circular central portion having two opposing sides thereto;

an annular rim surrounding said central portion and integrally formed therewith, said rim comprising a top end substantially in the area where the rim is integrally formed with the circular central portion and a bottom edge distal to the top end;

at least one means for removable attachment of a replaceable light source located on said bottom edge of said rim; and at least one replaceable light source engaged by said attachment means, said light source being chemiluminescent disposed in a plane substantially parallel to the central portion of the disc;

and wherein said means for removable attachment of said light source extend less than 360° around the rim.

9. The disc of claim 8 wherein said attachment means comprises an elongated groove formed on the bottom edge of the rim, wherein said groove frictionally engages the light source to assist in holding said light source onto said rim.

10. The disc of claim 9 wherein the depth of the groove is substantially equal to the diameter of the light source.

11. The disc of claim 9 wherein said attachment means further comprises clips on said rim adjacent said groove to assist in holding said light source on said rim.

12. The disc of claim 8 wherein the light source is at least about 5 mm in diameter.

13. The disc of claim 1 wherein the device weighs about 175 grams and is about 10½ inches in diameter.

* * * * *